US006352444B1

(12) United States Patent
Yuzawa

(10) Patent No.: US 6,352,444 B1
(45) Date of Patent: Mar. 5, 2002

(54) COAXIAL CONNECTOR, COAXIAL CONNECTOR ASSEMBLY AND METHOD OF FABRICATION THEREOF

(75) Inventor: Fumio Yuzawa, Tokyo (JP)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/158,378

(22) Filed: Sep. 22, 1998

(30) Foreign Application Priority Data

Sep. 30, 1997 (JP) ..... 9-284377

(51) Int. Cl.[7] ..... H01R 13/627

(52) U.S. Cl. ..... 439/353; 439/578; 439/731; 385/56; 385/76

(58) Field of Search ..... 174/88; 607/122; 385/56, 76, 70; 439/541.5, 607, 29, 63, 578, 585, 357, 358, 353, 731, 923; D13/24

(56) References Cited

U.S. PATENT DOCUMENTS

| | | | | | |
|---|---|---|---|---|---|
| 4,307,926 | A | * | 12/1981 | Smith | 339/177 R |
| D309,725 | S | * | 8/1990 | O'Grady | D13/24 |
| 5,003,283 | A | * | 3/1991 | Cenky | 337/403 |
| 5,120,241 | A | * | 6/1992 | Nakata et al. | 439/585 |
| 5,125,854 | A | * | 6/1992 | Bassler et al. | 439/607 |
| 5,228,874 | A | * | 7/1993 | Lin | 439/687 |
| 5,514,172 | A | * | 5/1996 | Mueller | 607/122 |
| 5,562,506 | A | * | 10/1996 | Wright | 439/675 |
| 5,567,179 | A | * | 10/1996 | Voltz | 439/578 |
| 5,645,454 | A | * | 7/1997 | Kosmala | 439/675 |
| 5,746,619 | A | * | 5/1998 | Harting et al. | 439/352 |
| 5,911,599 | A | * | 6/1999 | Masuda | 439/610 |
| 5,989,072 | A | * | 11/1999 | Hickox et al. | 439/701 |
| 5,997,349 | A | * | 12/1999 | Yoshioka | 439/579 |
| 6,019,519 | A | * | 2/2000 | Grinderslev et al. | 385/56 |
| 6,019,521 | A | * | 2/2000 | Manning et al. | 385/77 |
| 6,045,402 | A | * | 4/2000 | Embo et al. | 439/579 |
| 6,097,873 | A | * | 8/2000 | Filas et al. | 385/140 |
| 6,102,581 | A | * | 8/2000 | Deveau et al. | 385/56 |
| 6,129,581 | A | * | 10/2000 | Lee | 439/497 |
| 6,130,977 | A | * | 10/2000 | Rosson | 385/76 |
| 6,132,244 | A | * | 10/2000 | Leeman et al. | 439/541.5 |
| 6,153,830 | A | * | 11/2000 | Montena | 174/88 C |

FOREIGN PATENT DOCUMENTS

| | | | |
|---|---|---|---|
| JP | 4-56085 | 2/1992 | H01R/17/04 |
| JP | 4-78784 | 7/1992 | H01R/17/04 |

* cited by examiner

*Primary Examiner*—Brian Sircus
*Assistant Examiner*—Hae Moon Hyeon

(57) ABSTRACT

Plug connector (20) has a latch arm (22) intended for engagement with a mating cap connector (70). The latch arm (22) has a latching lug (25) and a cam lug (27) having a tapered surface (26). When the plug connector (20) is connected to the cap connector (70), the cam lug (27) is accommodated in a groove (77) provided in an individual cavity (81) of a cavity opening (72) of the cap connector (70). The latch arm (22) can be bent by inserting a tool in the groove (77) from its end (77*a*) and pressing on the cam lug (27), thereby releasing the engagement between the latching lug (25) and the cap connector (70) so that the plug connector can be disconnected from the cap connector.

10 Claims, 4 Drawing Sheets

COAXIAL CONNECTOR, COAXIAL CONNECTOR ASSEMBLY AND METHOD OF FABRICATION THEREOF

FIELD OF THE INVENTION

The present invention relates to coaxial connectors that are connected to coaxial cables and can be connected to mating connectors, to assemblies containing such connectors and to a method of assembly of fabrication of coaxial connector assemblies.

BACKGROUND OF THE INVENTION

An example of a coaxial connector and of an assembly comprising mating connectors can be found in Japanese Patent Publication No. 4-56085. The coaxial connector described in this publication has an outer contact member to which an outer conductor of a coaxial cable is connected, an inner contact member to which a center conductor of the coaxial cable is connected and a housing accommodating the contact members. The outer contact member and inner contact member are connected respectively to the outer and inner conductors of the coaxial cable by crimping. The inner contact member is located inside the outer contact member and the housing accommodates the outer contact member. The housing has a latch arm on one side intended for latching engagement with a mating connector. The coaxial connector, together with another coaxial connector connected thereto, forms a coaxial connector assembly. The mating coaxial connector comprises only one receiving cavity for the coaxial connector. The cavity has a latch member engaging with the latch arm.

Japanese Patent Publication No. 4-78784 represents another example of a coaxial connector and assembly comprising such a connector. The coaxial connector has an outer contact member to which an outer conductor of a coaxial cable is connected, an inner contact member to which a center conductor of the coaxial cable is connected and a housing accommodating the contact members. The housing contains multiple outer contact members and inner contact members. Therefore, when the coaxial connector is connected to with a mating coaxial connector, multiple coaxial connections are formed.

However, in recent years, a demand has arisen for modular type coaxial connector assemblies accommodating multiple coaxial connectors connected to coaxial cables for the connection of mating coaxial connectors thereto. In this practical application, the multiple coaxial connectors are of the same type, and it is also required that the mating connectors can be connected at a desired position or that these positions can be changed. In order to reduce the overall dimensions of the assembly, it is necessary to minimize the pitch at which the coaxial connectors are arrayed. At the same time, it is necessary to provide a possibility for the user to unplug individually any of the multiple coaxial connectors arrayed at a relatively narrow pitch. It is also desirable that the structure of the assembly should prevent the connectors from being inadvertently unplugged due to some external force applied to the coaxial cables. In addition, it is also desirable to provide a possibility of adjustment of the impedance of coaxial connectors to an optimal value, and to assure the ease of the assembly operations in forming the coaxial connector assemblies.

Therefore, the main purpose of the present invention is to provide a coaxial connector and an assembly thereof making it possible to plug in multiple mating coaxial connectors, especially at a narrow pitch, and to unplug any individual connector.

Another main purpose of the present invention is to provide, along with the coaxial connector, a method of fabrication providing for an easy assembly process, including conductor termination.

SUMMARY OF THE INVENTION

The present invention is directed to a coaxial connector comprising an outer contact member having a connecting section located at a front end for connecting to a mating connector and a terminating section located at a rear end for connection to an outer conductor of a coaxial cable, an inner contact member located inside the outer contact member and for connection to an inner conductor of the coaxial cable, and a housing accommodating the outer and inner contact members and having a latch arm latching with a mating housing when the connector is connected to a mating connector. The latch arm is formed in a cantilevered configuration extending forward from a rear portion of the housing and it has a latch engaging with the mating housing in the form of a lug having a cam surface that is used to release the engagement formed by the latch by means of a tool that can be inserted from a back end providing a cam action on the cam surface.

The outer contact member has practically the same diameter between the connecting section and the terminating section, and lugs extend outward from its outer surface for securing the outer contact member in the housing.

The latch arm has a means preventing it from deformation that can be caused by excessive bending.

A protective wall is provided in front of the latch arm protecting it from the front direction.

The present invention is also directed to a coaxial connector assembly having plug connectors connected to coaxial cables and a cap connector equipped with cavities receiving the plug connectors, with the cap connector and the plug connectors being electrically connected to each other, the cap connector has a relatively large cavity opening in which multiple cavities are arrayed that are intended for the accommodation of the plug connectors arranged in a row close to each other, and that multiple latch surfaces are located inside and along one edge of the cavity opening in the direction of the row of cavities, the purpose of which is to engage the plug connectors individually, and that engagement between the latch and the plug connectors can be released by means of a tool that is inserted in the cavity opening in the same direction as the plug connectors at the time of connection.

The plug housing has a latch arm engaging with the latch surface and that the latch arm has a tapered cam surface interacting with the tool, thereby providing a cam action to unlatch the latch arm from the latch surface.

A groove is provided in the cavity opening which can accommodate the cam lug of the latch arm having the cam surface facing backwards or towards the cavity opening.

The present invention is also directed to a method of fabrication of the coaxial connector comprising placing of terminating sections located at rear ends of outer contact members in a generally rectangular housing so that the terminating sections extend from a rear side of the housing, terminating a center conductor of a coaxial cable to an inner contact member, and passing the center conductor of the coaxial cable terminated to the inner contact member inside the outer contact member and crimping an outer surface of the terminating section to an outer conductor of the coaxial cable.

For the placement of the outer contact member in the housing, the housing is made of two halves that are placed over the outer contact member from mutually opposed directions and secures the outer contact member in the housing by joining the two halves together.

The crimping of the outer conductor by using a sleeve placed over the outer conductor and terminating it by crimping the sleeve.

A coaxial connector for matable engagement with a matable housing comprises an insulating housing having an outer contact member disposed therein, a dielectric bushing having a through hole in a connecting section of the outer contact member and having an inner contact member disposed therein, a terminating section provided by the outer contact member, and latch arm provided by the insulating housing and having a latching lug for latching engagement with a latching surface of the matable housing to latch the coaxial connector therein, wherein the connecting section extends outwardly from a front end of the insulating housing, the terminating section extends outwardly from a back end of the insulating housing, and a cam lug is provided on the latch arm and is engagable by a tool to disconnect the latching lug from the latching surface so that the coaxial connector can be disconnected from the matable housing.

BRIEF DESCRIPTION OF THE DRAWINGS

An embodiment of the present invention will now be described by way of example with reference to the accompanying drawings in which.

DETAILED DESCRIPTION OF THE DRAWINGS

Figure 1:
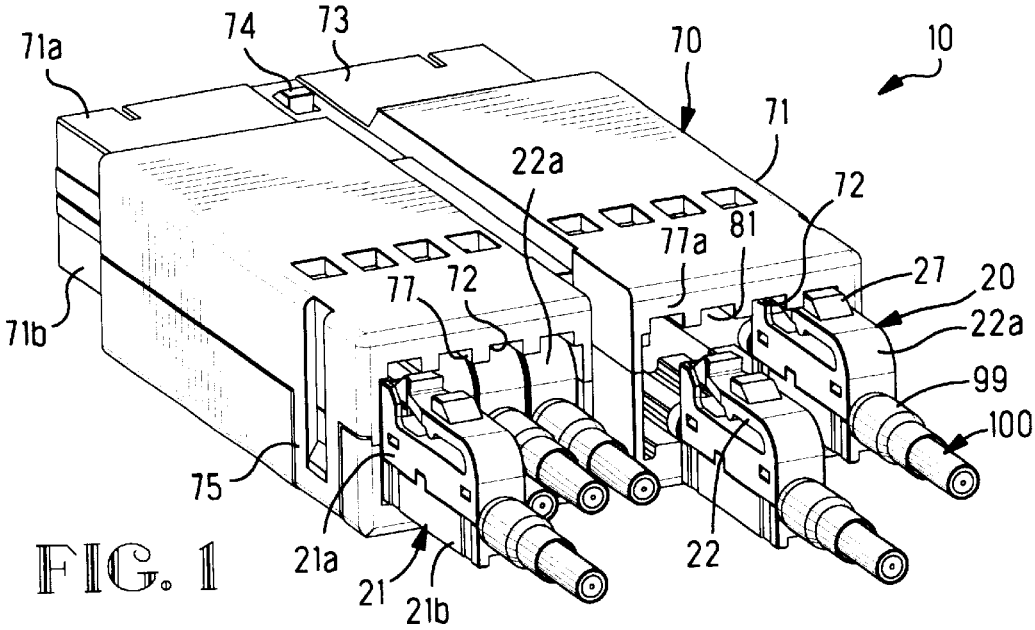
FIG. 1 is a perspective view of an assembly of coaxial connectors according to the present invention.

As can be seen from FIG. 1, coaxial connector assembly 10 has multiple coaxial plug connectors 20 and one cap connector 70. Housing 71 of the cap connector 70 has one cavity opening 72 and it is configured in such a manner that it can accommodate four plug connectors 20 arranged in a single row at a narrow pitch. At the end opposite to the cavity opening 72, a unit 73 intended for mating connectors is provided. A lug 74 is for engagement with other connectors. The housing 71 has upper and lower sections 71*a*, 71*b* that are retained together by means of a latch structure 75. It should be noted that the cavity 72 is formed by joining the sections 71*a* and 71*b* together.

From FIG. 1, it can be seen that the coaxial cable 100 is terminated to the plug connector 20. Housing 21 of the plug connector 20 comprises two sections 21*a*, 21*b*. As can be seen from FIG. 2, on an upper surface of the housing upper section 21*a*, a latch arm 22 is located, and it extends forward from a rear end of the upper section. At the rear end of the housing 21, a sleeve 99 is provided for crimping of an outer conductor of the coaxial cable 100.

Figure 2:
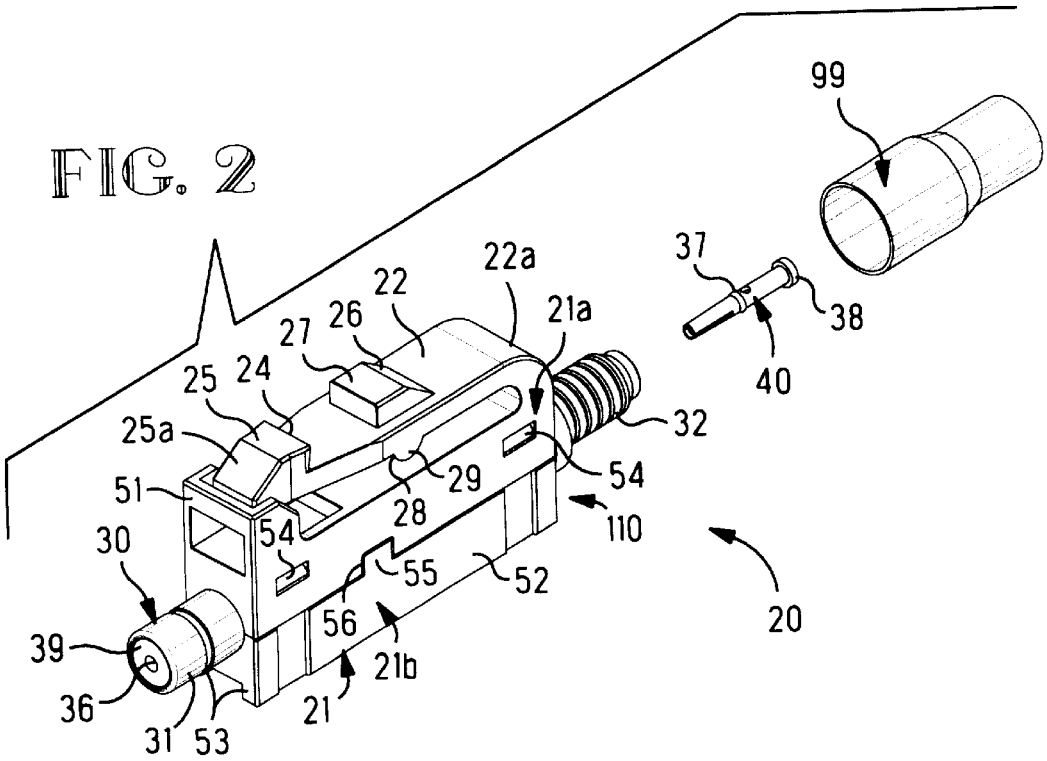
FIG. 2 is an exploded perspective view showing the structure of a plug connector.
Figure 3:
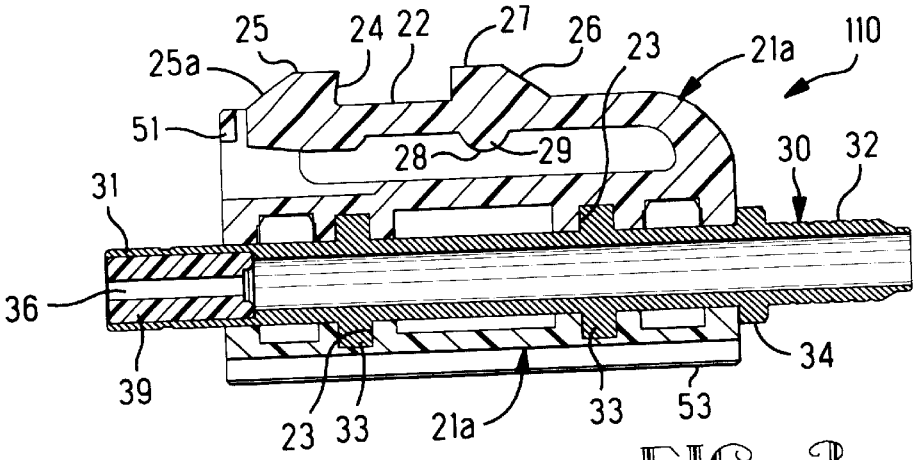
FIG. 3 is a longitudinal cross-sectional view showing a subassembly of the plug connector.

As can seen from FIGS. 2 and 3, the plug connector 20 is a subassembly 110 comprising an outer contact member 30, the upper and lower housing sections 21*a*, 21*b*, an inner contact member 40 and the sleeve 99. The coaxial cable 100 (see FIG. 1) with inner contact member 40 connected to it forms the plug connector 20 after it is inserted in and connected to the outer contact member 30. The method of connection is explained below. The outer contact member 30 is secured in the housing 21 so that its front and rear ends extend from the housing 21. The portion extending to the front has a connecting section 31 matching to the configuration of the mating connector, and the section extending to the rear has a terminating section 32 for the connection of the outer conductor of the coaxial cable 100 thereto.

As can be seen from FIG. 3, the subassembly 110 is formed by joining together the outer contact member 30 with a dielectric bushing 39 inserted in the coupling section 31. The outer contact member 30 is of the same diameter from the connecting section 31 to the terminating section 32, and, as can be seen from FIG. 3, has flanges 33 at several locations along the length thereof. The flanges are provided for the purpose of securing the outer contact member 30 in the housing 21. Therefore, housing sections 21*a*, 21*b* have grooves 23 accommodating flanges 33. The outer contact member 30 is secured in the housing by assembling together the outer contact member 30 and the housing sections 21*a*, 21*b*. An additional flange 34 is provided at a back end of the housing 21, the purpose of which is different from that of flanges 33. It is used for the operation of the connection of the coaxial cable taking place later and also serves as a means for the joining of sections 21*a*, 21*b* of the housing 21. An important feature of the subassembly 110 exterior is that the cylindrical outer contact member 30 is accommodated in the rectangular housing 21. This facilitates the operations related to the connection of the coaxial cable 100 to plug connector 20.

At a front end of the latch arm 22, latching lug 25 has an engaging or latching shoulder 24 that is used when the connector is coupled with the cap connector 70. At the front end of the latching lug 25, a tapered surface 25*a* is located. Approximately at the middle of the latch arm 22, a cam lug 27 is provided that has a tapered cam surface 26 facing rearwardly. The cam lug 27 is narrower than the latching lug 25. The operation of the cam lug 27 is explained below. A lug 29 having an arcuate surface 28 is located under the cam lug 27. The lug 29 is used as a stop member preventing the latch arm 22 from excessive bending. In front of the latch arm 22, a fixed protective wall 51 is provided, the purpose of which is to protect the latch arm from damage during connection with a mating connector. At the rear of the latch arm 22 of the plug connector 20, a rounded surface 22*a* is located. The purpose of rounded surface 22*a* is explained below.

On a bottom surface of the lower housing section 21*b*, a pair of rails 53 are located parallel to the side walls 52. Their purpose is explained below. Rails 53 extend along the entire length of the lower housing section 21*b*.

As can be seen from FIG. 2, the upper housing section 21*a* and the lower housing section 21*b* are maintained together by means of latches 54 of lower housing section 21*b* disposed in apertures 54*a* of upper housing section 21*a*. The latches 54 and apertures 54*a* are located at four locations in mutually opposed surfaces. When the upper and lower sections of the housing are joined together, protrusion 55 of the lower housing section 21*b* fits into recess 56 of the upper housing section 21*a*, thus providing for an accurate alignment and preventing a loose connection between the housing sections.

Figure 4A:
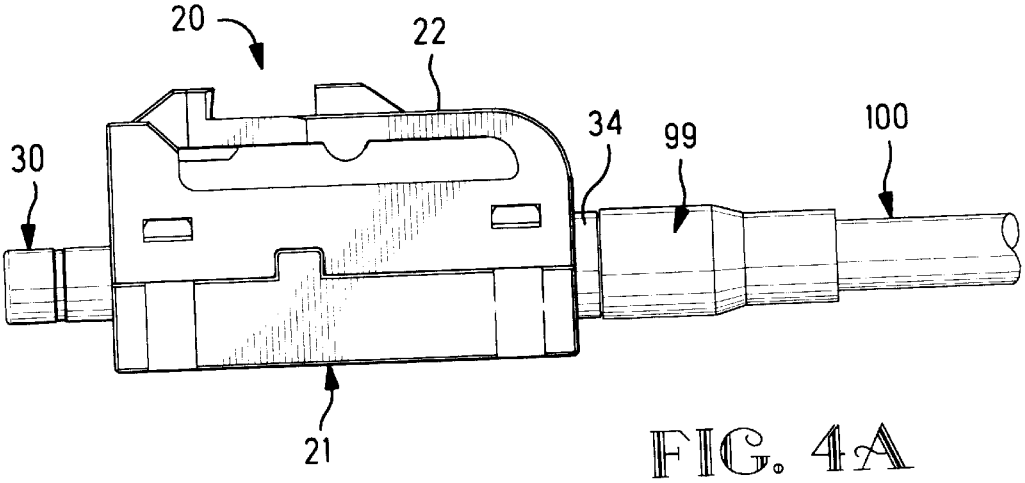
FIGS. 4*a* and 4*b* show an assembled plug connector with FIG. 4*a* being a side view and FIG. 4*b* is an enlarged longitudinal cross-sectional view of FIG. 4*a*.
Figure 4B:
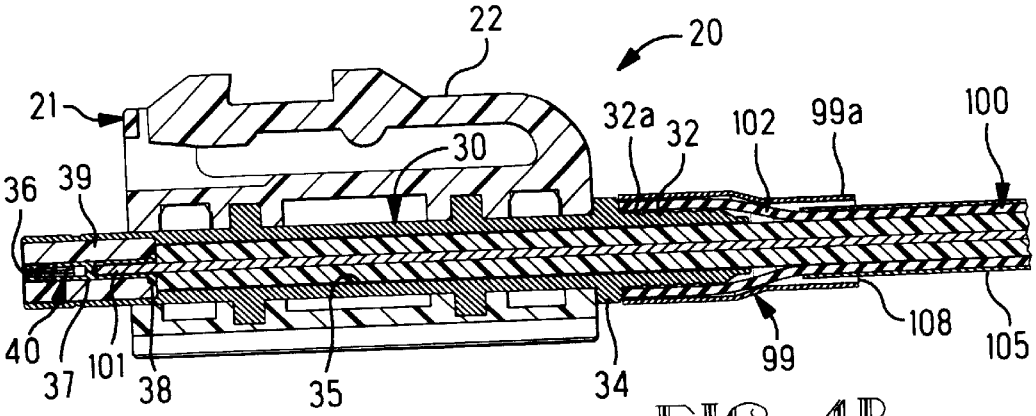

The inner contact member 40 shown in FIG. 2 is connected by crimping to an appropriately prepared end of an inner or center conductor 101 of the coaxial cable 100. After that, the inner contact member 40 is inserted in the cavity 35 of the outer contact member 30 along with the inner dielectric sleeve surrounding the center conductor. This assembly process can be better understood from FIGS. 3 and 4. The inner contact member 40 is inserted in the through hole 36 of the dielectric bushing 39 and secured therein. In order to provide for a reliable retention in the through hole 36, the inner contact member 40 has an annular collar 37 (see FIG. 2) and a flange 38 acting as a stop member preventing the advancement of the inner contact member beyond the required position. As shown in FIG. 4*b*, when the inner contact member 40 is secured in the dielectric bushing 39, its front end is practically at the same position as the front end of the dielectric bushing 39 so that they are substantially in alignment.

As can be seen from FIG. 4*b*, the outer conductor 102 of the coaxial cable 100 is positioned over the terminating section 32 of the outer contact member 30, and it is secured thereto by means of the sleeve 99 that is crimped over the outer surface 32*a* of the terminating section 32. The sleeve 99 is crimped when it is against the flange 34 of the outer contact member 30. A narrow gap 108 exists between a rear portion 99*a* of the sleeve 99 and an outer insulating jacket 105 of the coaxial cable 100. Gap 108 allows for slight deviations of the coaxial cable 100, and the rear portion 99*a* prevents excessive deviations.

Figure 5:
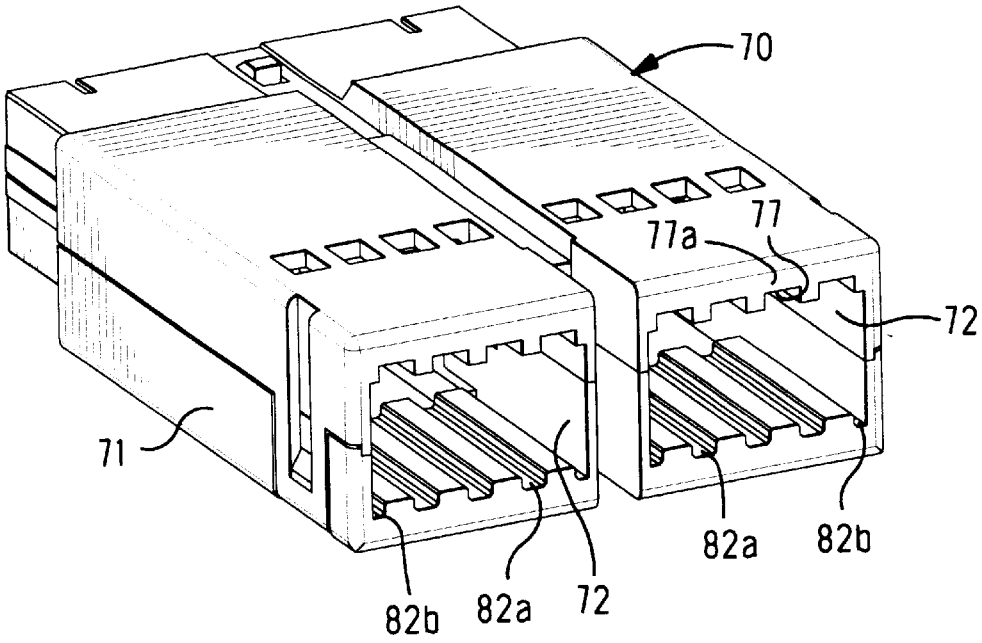
FIG. 5 is a perspective view of a cap connector housing.
Figure 6:
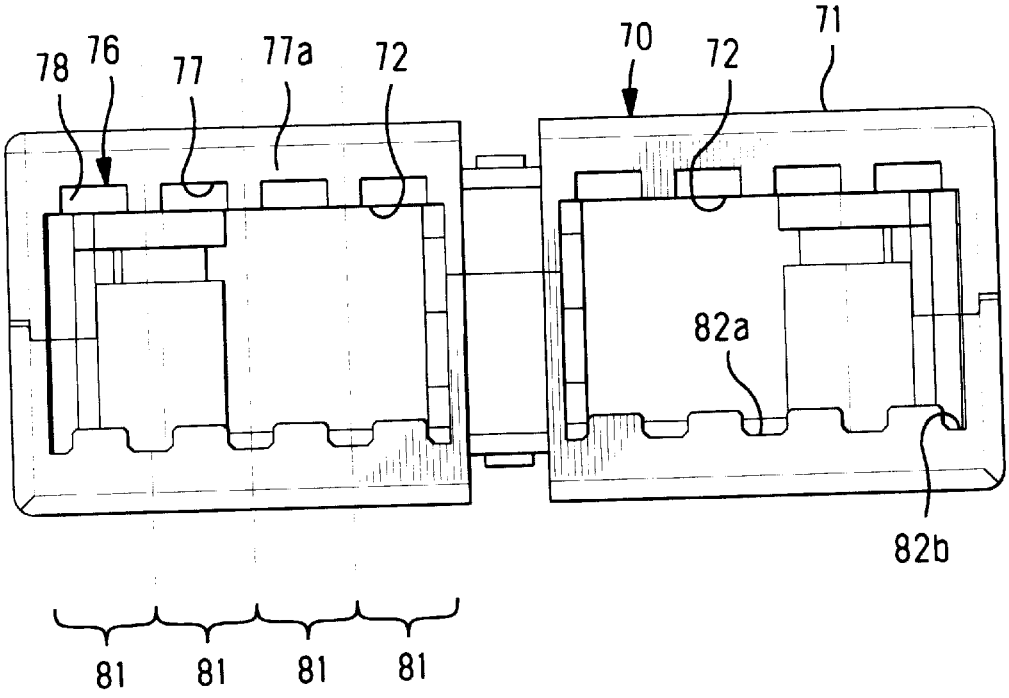
FIG. 6 is a front view of the cap connector housing of FIG. 5.

As can be seen from FIGS. 5 and 6, the housing 71 of the cap connector 70 has multiple individual through cavities 81 having a configuration corresponding to housings 21 of the plug connectors 20 that are arranged in a row. On an upper surface of individual cavities 81, latches 76 are provided that are engaged with the latch arms 22. The latches 76 include grooves 77 extending along the entire length of individual cavities 81 and latch lugs 78. The width of the grooves 77 is equal to the width of cam lugs 27 of the latch arms 22. As shown in FIG. 5, the grooves 77 extend to the edge of the housing 71 and form openings 77*a* in a fixed wall of the housing.

At the bottom surface of individual cavities 81, guiding grooves 82*a*, 82*b* are located to accommodate parallel rails 53 provided on housings 21 of the plug connectors 20. The grooves are arranged in the cavity opening 72 in required locations (that is, in positions corresponding to each individual cavity 81) so that the plug connectors are positioned in correct locations and their insertion is smooth. As can be seen from FIG. 6, grooves 82*a* of adjacent individual cavities 81 are connected, and grooves 82*b* located at both ends of the cavity opening 72 are of singular width.

Figure 7:
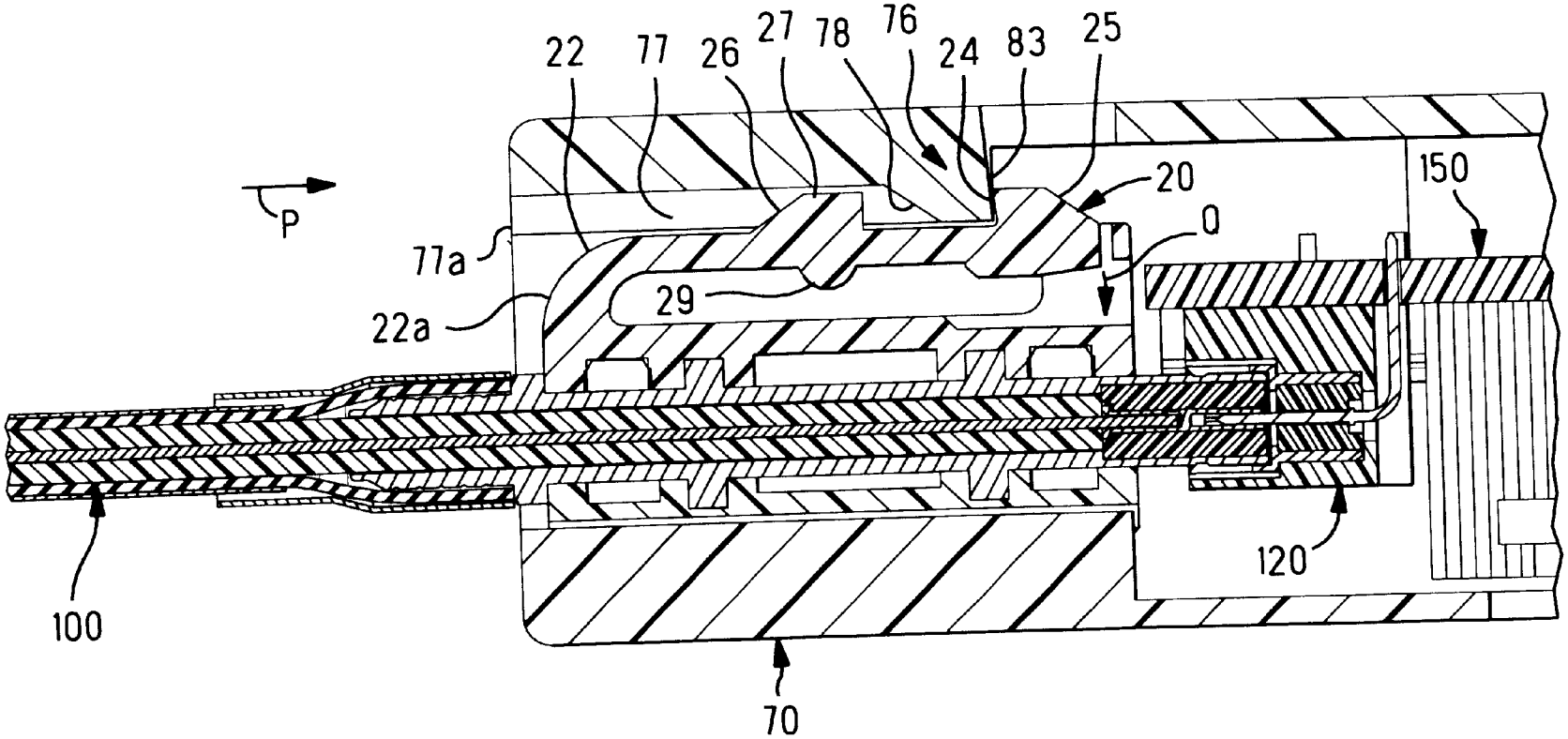
FIG. 7 is a part cross-sectional view showing an engagement state of one plug connector and the cap connector.

The plug connector 20, as can be seen in FIGS. 1 and 7, forms a coaxial connector assembly 10 with the cap connector 70 (see FIG. 1). As shown in FIG. 7, inside the cap connector 70, a coaxial connector 120 mounted on printed circuit board 150 is located. The inner contact member 40 and the outer contact member 30 of the plug connector 20 are electrically connected with an inner contact member and an outer contact member, respectively, of coaxial connector 120. In this position, the engaging shoulder 24 of the latching lug 25 of the latch arm 22 engages with latching shoulder or surface 83 of latching lug 78 of the cap housing 70. This prevents the plug connector 20 from being pulled out of the cap connector 70. The cam lug 27 located in the middle of the latch arm 22 is disposed into the groove 77 and is positioned away from the latching lug 25. The tapered surface 26 is located in the groove 77 and faces backward.

In order to release the plug connector 20 from the cap connector 70 shown in FIG. 7, an appropriate tool is inserted from the back. The tool can be a blade screw driver or other flat object. The tool is inserted from the end 77*a* into the groove 77. As can be clearly seen from FIGS. 1 and 7, the role of the rounded or arcuate surface 22*a* of the latch arm 22 is to guide the inserted tool into the groove 77. Since only the cam lug 27 is present inside the groove 77, the tool, for example, a blade screw driver, is guided to the tapered surface 26 of the cam lug 27. Therefore, the operation of unplugging a specific plug connector 20 can be performed very easily. The arrow P indicates the direction in which the inserted tool applies pressure on the tapered surface 26, and the arrow Q shows the direction in which the latch arm 22 is bent. As a result, the engaging shoulder 24 and the shoulder 83 are disengaged. Looking again at FIG. 1, it can be seen that any of multiple plug connectors 20 connected with the cap connector 70 can be easily unplugged, thus assuring easy connections and disconnections.

Above, detailed explanations concerning the preferred embodiments of the coaxial connector, the coaxial connector assembly using such connectors and the method of fabrication of coaxial connectors according to this invention have been provided. However, this invention is not limited by these embodiments, and that various modifications and changes may be made by experts in this field of technology.

The coaxial connector according to the present invention has a latch arm of a cantilevered configuration extending forward from a rear end of a housing, and since the latch arm has a latching lug that is engaged with a housing of a mating connector and a lug with a tapered surface facing backward which can be accessed from a back side of the mating connector by a tool for the purpose of disengaging the latched condition with the mating connector by means of cam action, only some space at the back of the coaxial connector is required for the release of the connector engagement, thus making it possible to reduce the space needed for the connection of the coaxial connector and to provide more freedom in the design of such connectors.

The assembly of coaxial connectors according to the present invention comprises a cap connector having multiple cavities for the reception of multiple plug connectors arranged in a row and joined together, thus forming a relatively large cavity opening. The cap connector also has a row of multiple latches arrayed inside the cavity opening along one edge thereof. The engagement with the plug connectors formed by the latches can be released by means of a tool inserted in the cavity opening from the same direction as the direction of connection of the plug connectors, thus making it possible to insert the plug connectors in and unplug them from the cap connector individually. The effect of this is the fact that the assembly of coaxial connectors according to the present invention makes it possible to arrange plug connectors not only in horizontal but also in vertical rows and to plug and unplug them individually.

The method of fabrication of the coaxial connectors according to the present invention offer the following advantages: since the process of fabrication involves the step of placement of an outer contact member having a round cross section in a housing having a rectangular configuration so that a terminating section of the outer contact member located near a rear end thereof extends from a rear end of the housing, a step of connecting a center conductor of a coaxial cable to an inner contact member, and the step of passing the coaxial cable with terminated inner conductor to the inner contact member through the outer contact member and securing an outer conductor of the coaxial cable on a terminating section of the outer contact member by means of crimping, the operator's task becomes easier because of having to handle a housing of rectangular configuration that is larger than the outer contact member, and the connection or termination of the coaxial cable to the coaxial connector, especially the connection of the outer conductor to the outer contact member can be performed with great ease.

What is claimed is:

1. A coaxial connector for matable engagement with a matable housing, comprising:

an insulating housing having an outer contact member disposed therein;

a connecting section of the outer contact member extending outwardly from a front end of the insulating housing;

a dielectric bushing provided with a through hole disposed in the connecting section;

an inner contact member for connection to a center conductor of a coaxial cable and for disposition in the through hole of the dielectric bushing;

a terminating section extending outwardly from a back end of the insulating housing for connection to an outer conductor of the coaxial cable; and a latch arm extending forward on the insulating housing, the latch arm having a latching lug for latching engagement with a latch surface in the matable housing to latch the coaxial connector therein, and a cam lug having a tapered surface facing backward, the tapered surface being engagable by a tool inserted from the back end of the insulating housing to disconnect the latching lug from the latch surface so that the coaxial connector can be disconnected from the matable housing.

2. A coaxial connector as claimed in claim 1, wherein the insulating housing comprises an upper housing section and a lower housing section, and latch members latching the upper and lower housing sections together.

3. A coaxial connector as claimed in claim 2, wherein the outer contact member has flanges disposed in grooves within the upper and lower housing sections.

4. A coaxial connector as claimed in claim 3, wherein another flange is provided on the outer contact member engaging an outer surface of the back end of the insulating housing.

5. A coaxial connector as claimed in claim 1, wherein the latch arm extends from the back end toward the front end as a cantilever latch arm.

6. A coaxial connector as claimed in claim 5, wherein a protective wall is provided by the insulating housing adjacent a front end of the latch arm.

7. A coaxial connector as claimed in claim 1, wherein a stop member is provided on an inside surface of the latch arm.

8. A coaxial connector assembly comprising:

a cap connector including an insulating housing member provided with cavities having latch surfaces, and coaxial connectors at inner ends of the cavities;

plug connectors for insertion into respective said cavities of the insulating housing member, each of the plug connectors having an insulating housing, an outer contact member in the insulating housing having a connecting section extending outwardly from a front end of the insulating housing, and a terminating section extending outwardly from a back end of the insulating housing, a dielectric bushing in the connecting section having an inner contact member disposed in the dielectric bushing and connected to a center conductor of a coaxial cable while an outer conductor of the coaxial cable is connected to the terminating section, the connecting section being connected with the coaxial connector at the inner end of the cavity when the plug connector is inserted therein; and a respective latch arm extending forward on the insulating housing of each of the plug connectors, each said latch arm having a latching lug for latching engagement with one of the latching surfaces, and a cam lug having a tapered surface facing backward, each said tapered surface being engagable by a tool inserted from the back end of the insulating housing to disconnect a respective said latching lug from a respective said latching surface so that the plug connector can be individually disconnected from the coaxial connectors.

9. A coaxial connector assembly as claimed in claim 8, wherein the cavities include grooves in which the cam lugs are disposed and along which the tool is moved.

10. A coaxial connector assembly as claimed in claim 8, wherein bottom surfaces of the cavities have guiding grooves along which rails provided along bottom surfaces of the insulating housings of the plug connectors move.

* * * * *